US012133551B2

(12) United States Patent
Brinker et al.

(10) Patent No.: US 12,133,551 B2
(45) Date of Patent: Nov. 5, 2024

(54) SMOKING ARTICLE AND METHOD FOR COOLING A HEATED PARTICLE-LOADED GAS

(71) Applicant: DEUTSCHE BENKERT GMBH & CO. KG, Herne (DE)

(72) Inventors: Arnd Brinker, Luedinghausen (DE); Rafael Paul Bula, Oer-Erkenschwick (DE); Jörg Enno Karper, Waltrop (DE)

(73) Assignee: DEUTSCHE BENKERT GMBH, Herne (DE)

( * ) Notice: Subject to any disclaimer, the term of this patent is extended or adjusted under 35 U.S.C. 154(b) by 660 days.

(21) Appl. No.: 16/643,017

(22) PCT Filed: Aug. 14, 2018

(86) PCT No.: PCT/EP2018/072033
§ 371 (c)(1),
(2) Date: Feb. 28, 2020

(87) PCT Pub. No.: WO2019/042762
PCT Pub. Date: Mar. 7, 2019

(65) Prior Publication Data

US 2020/0329757 A1 Oct. 22, 2020

(30) Foreign Application Priority Data

Sep. 1, 2017 (DE) ..... 10 2017 120 202.1

(51) Int. Cl.
*A24D 3/04* (2006.01)
*A24D 3/17* (2020.01)
*A24F 13/04* (2006.01)

(52) U.S. Cl.
CPC ..... *A24D 3/04* (2013.01); *A24F 13/04* (2013.01); *A24D 3/17* (2020.01)

(58) Field of Classification Search
CPC ..... A24D 3/061; A24D 1/04; A24D 3/0275; A24D 3/04; A24F 13/04
See application file for complete search history.

(56) References Cited

U.S. PATENT DOCUMENTS 3,513,859 A 5/1970 Carty
3,547,130 A 12/1970 Harlow et al.
(Continued)

FOREIGN PATENT DOCUMENTS

DE 102004043222 A1 3/2006
WO 2013027066 A2 2/2013

*Primary Examiner* — Michael H. Wilson
*Assistant Examiner* — Stephanie Lynn Moore
(74) *Attorney, Agent, or Firm* — Calderon Safran & Wright, P.C.; David S. Safran

(57) ABSTRACT

A smoking article (1) having a mouthpiece (2) for drawing in a particle-loaded gas (3), the particle-loaded gas (3) being heated. To provide a smoking article in which the temperature of the gas, aerosol or humidity absorbed by the user of the smoking article is reduced, the smoking article has at least one cooling element (4) for cooling the particle-loaded gas (3), the particle-loaded gas (3) flowing through the cooling element (4) during the drawing-in action. The cooling element (4) has a cooling material (5), and the cooling element (4) carries out the cooling by an endothermic process of the cooling material (5), the endothermic process being activated by the heated particle-loaded gas.

15 Claims, 2 Drawing Sheets

(56) References Cited

U.S. PATENT DOCUMENTS

| | | | | |
|---|---|---|---|---|
| 3,625,228 | A | 12/1971 | Dock | |
| 3,669,128 | A | 6/1972 | Cohen | |
| 3,946,748 | A * | 3/1976 | Frankfurt | A24D 3/04 131/339 |
| 4,343,320 | A * | 8/1982 | Muto | A24D 3/045 131/210 |
| 4,838,286 | A | 6/1989 | Phelpstead | |
| 2015/0027474 | A1 | 1/2015 | Zuber et al. | |
| 2016/0249675 | A1 * | 9/2016 | Branton | A24D 3/06 131/335 |
| 2016/0331024 | A1 * | 11/2016 | Cameron | A24F 40/50 |

* cited by examiner

SMOKING ARTICLE AND METHOD FOR COOLING A HEATED PARTICLE-LOADED GAS

BACKGROUND OF THE INVENTION

Field of the Invention

The invention relates to a smoking article having a mouthpiece for drawing in a particle-loaded gas, wherein the particle-loaded gas is heated. In addition, the invention also relates to a method for cooling a heated particle-loaded gas in a smoking article.

Description of the Related Art

A smoking article, typically a cigarette, has at least one tobacco section that is encased in a covering material. In many cases, smoking articles are equipped with filters in order to influence the type and amount of substances in the smoke. Such filters, usually made of cellulose acetate or paper, can reduce the particle portion of the smoke. Filters can also include other materials such as activated charcoal or flavoring agents.

It is common knowledge that plenty of substances that are harmful to health are produced during the burning of tobacco in smoking articles. Thus, it is of interest in the industry to produce smoking articles whose smoke contains appreciably fewer harmful substances.

Meanwhile, electronic cigarettes, or e-cigarettes, as well as electronic vaporization devices are widespread in the state of the art. These are known in the state of the art in different designs and are used as a substitute for traditional tobacco cigarettes that are burned. They have an advantage over tobacco cigarettes in terms of health since, due to the vaporization of the liquid provided, no burning takes place during which, otherwise, a large amount of toxins is released. As a result, they can be seen as being less harmful to the health.

In the known e-cigarettes, a fluid or liquid contained in a tank is led to a vaporizer, in which it is vaporized. The vapor is then led via a flow channel to an outlet opening in a mouthpiece and can be inhaled by the user. In order to convey the liquid to the vaporizer, carrier materials are usually used. These can, for example, be formed of glass fiber, cotton batting, stainless steel strainers or the like.

In addition, so-called "heat not burn" products are gaining greater popularity. Here, tobacco is not burned, as in a traditional cigarette, but only heated by an additional electronic device. This avoids the formation of substances harmful to health, which would be produced by the thermal decomposition of the tobacco during its burning.

All above-mentioned products, as well as traditional smoking articles, have the disadvantage that the vapor or smoke that has been breathed in is ingested by the user at a high temperature. This can be unpleasant for the user.

SUMMARY OF THE INVENTION

Thus, the object of the present invention is to provide a smoking article as well as a method for cooling a heated particle-loaded gas, in which the temperature of the gas, aerosol or vapor ingested by the user from a smoking article is reduced.

This object is achieved with the smoking article in which at least one cooling element is included for cooling the particle-loaded gas, wherein the particle-loaded gas flows through the cooling element during the drawing-in action, wherein the cooling element has a cooling material, wherein the cooling by the cooling element is implemented by means of an endothermic process of the cooling material and wherein the endothermic process is activated by the heated particle-loaded gas. A particle-loaded gas is to be understood, in general, as a gas that contains a further component, especially also aerosols having solid and/or fluid components such as vapor, mist and smoke.

When consuming a smoking article, the user usually draws air through a mouthpiece. The air flows through the smoking article. In a traditional cigarette, tobacco smoke is additionally drawn in, which initially flows through the tobacco section and possibly through a filter before it exits the mouthpiece and can be inhaled by the user. In the present invention, a cooling element is additionally provided, through which the drawn-in air, for example, tobacco smoke, has to flow before the flow of gas, i.e., the mixture of drawn-in air and tobacco smoke or wet vapor of an e-cigarette, called particle-loaded gas in the following, can exit the mouthpiece.

The cooling element contains a cooling material, which the particle-loaded gas can flow by and/or flow through. The particle-loaded gas is heated due to a vaporization or burning process. This heat is used to activate an endothermic process in the cooling material. In an endothermic process, energy has to be added from outside so that the process is started and can be carried out. This energy is provided by the heated or warmed particle-loaded gas. When exiting the cooling element, the particle-loaded gas has, as a result, a lower heat content (enthalpy) than before entering into the cooling element. A lower heat content is synonymous with a lower temperature. The particle-loaded gas, thus, exits the mouthpiece with a substantially lower temperature than it would have had, if the endothermic process of the cooling material in the cooling element had not been activated.

The manner of the course of action of the endothermic process depends on the type and nature of the cooling material. In one advantageous design of the invention, it is thus provided that the endothermic process is implemented by means of desorption. Here, it has been shown to be advantageous to use materials, as a cooling material, that can release the absorbed water into the surroundings. Thus, in particular, silica gel and/or zeolite can be used as cooling means.

In a further development of the invention, it is provided that the endothermic process is implemented by means of melting and/or vaporizing of the cooling material. Energy is also introduced to the cooling material in melting and/or vaporizing. The required melting or vaporizing heat content; i.e., the amount of energy that is required to melt a material sample at its melting point at constant pressure or, respectively, to vaporize it at its boiling point, i.e., to convert it from a solid to a fluid or from a fluid to a gaseous aggregate state, which is introduced from outside; ensures that the particle-loaded gas is cooled before it exits the mouthpiece. Both organic and inorganic substances are suitable as cooling materials.

A further additional or alternative possibility for carrying out the endothermic process is provided by the endothermic process being implemented by releasing water of crystallization of an inorganic salt. In particular, Glauber salt, i.e. sodium sulfate hydrate, and Epsom salt, i.e., magnesium sulfate hydrate, can thus be used as a cooling means. Sodium sulfate is used in the tobacco industry in part for smoldering retardation of covering materials, so that the covering material does not burn too quickly. This and corresponding similar inorganic salts exist as crystalline solid bodies under normal conditions. The water of crystallization or hydration water is bound within the solid body due to the crystalline lattice structure. As opposed to desorption, in which the water molecules are not part of a crystal lattice, the water molecules in these salts are dative bonds to ions or hydrogen bonds. Energy is required to release water of crystallization. The energy is provided by the heated particle-loaded gas. In this process, the particle-loaded gas is consequently cooled before it can exit the mouthpiece.

The cooling element can be arranged at different locations of the smoking article. It is provided in one design of the invention that a filter element is included, that the filter element is arranged in front of the mouthpiece in the flow direction of the particle-loaded gas and that the filter element includes the cooling element. By arranging the cooling element in the filter element, the smoking article, if it is, for example, a traditional cigarette, can be designed almost without any changes. A cigarette having a filter element already has structures in which the cooling element with the cooling material can be placed.

In a further development of the invention, it is provided that the cooling element has an elongated carrier material and that the elongated carrier material comprises the cooling material. The carrier material can also simultaneously form the cooling element.

To this end, it is provided in an advantageous development that the carrier material is multiply folded. In this manner, an as large as possible surface is created, which the particle-loaded gas flows by, or through. The carrier material can be formed of this material so that as many folds as possible and a correspondingly large surface can be implemented without disproportionately increasing the dimensions of the smoking article. The folds can also be designed such that the carrier material is rolled or cut and stacked in parts. The cooling material can be previously pressed or brushed onto the carrier material. In this manner, an application of as large a surface as possible is possible, as a result of which the particle-loaded gas can be cooled better.

The carrier material can be placed in the smoking article such that the folds are arranged in a direction transverse to the flow direction of the particle-loaded gas. In this manner, the particle-loaded gas has to flow through carrier material. For this design, it is recommended to choose a carrier material that does not cause a large pressure difference on the mouthpiece when the user inhales, so that inhaling is not perceived as strenuous or unpleasant. Thus, the carrier material should be permeable to air.

The carrier material can also be placed in the smoking article such that the folds are arranged in the flow direction of the particle-loaded gas. In this manner, the particle-loaded gas flows toward the carrier material, but not through it. In this design, it is not necessary that the carrier material be permeable to air.

Furthermore, it can be provided that the carrier material is simultaneously a part of the cooling element and the filter element. By arranging the folds in the direction of flow of the particle-loaded gas or transverse to it, additional filter material can be placed in the spaces between the folds for filtering the particle-loaded gas. It is also possible that the carrier material is produced directly of the filter material. Additionally, the alternative arrangement of the folds of the carrier material can be simultaneously implemented in the smoking article. In this case, the smoking article has a section in which the folds of the carrier material are arranged in the flow direction of the particle-loaded gas, and a section in which the folds are arranged transverse to the flow direction of the particle-loaded gas.

The cooling material can be arranged in different manners on the carrier material. In one design of the smoking article, the cooling material can be applied to the surface of the carrier material. It makes sense to press or brush on the cooling material. Thus, an application of the cooling material with a large as possible surface is possible, as a result of which the particle-loaded gas can be cooled better.

Alternatively, or additionally, it is provided that the cooling material is placed in the carrier material. The cooling material can be worked into the paper mass during production of the carrier material, which is made of paper, for example.

Additionally, or alternatively, in a further development of the invention, the cooling material is placed in the cooling element in small particles. The small particles can, for example, in addition to the above-described design, be placed in the empty spaces between the folds of the carrier material in order to further improve the effect of the cooling element. If the smoking article has a traditional filter, which also contains the cooling element, the cooling material can also be interspersed in the filter material. The filter element then has a double function, since it filters toxic substances out of the particle-loaded gas and simultaneously is responsible for cooling the particle-loaded gas.

Additionally, or alternatively, the cooling element can be provided directly in the tobacco mixture in a traditional smoking article having a tobacco mixture, wherein the small particles are then placed in the tobacco mixture. The size of the particles depends on the nature of the cooling material. In general, all particle size distributions are possible that do not disproportionately increase the dimensions of the smoking article. Disproportionate, in this case, means a large difference to the dimensions of a traditional smoking article.

A further development of the smoking article according to the invention provides that the cooling element is arranged in front of the mouthpiece in the flow direction of the particle-loaded gas as a separate segment. The separate segment can have a plurality of forms. For example, a preferred cylinder is described, to which the invention should not be limited. Traditional smoking articles are usually essentially cylinder-shaped. The separate segment can thereby additionally be arranged in front of a possible filter in the flow direction of the particle-loaded gas. The cooling element as separate segment can, for example, be formed completely of the cooling material. It is also possible that the separate segment has a type of housing, so that the cooling material in encapsulated as a porous material or a powder in the housing. The housing has an inlet opening and an outlet opening for the particle-loaded gas, through which it flows due to the user drawing in through the mouthpiece. The cooling element can also optionally be placed in or on the smoking article. In this manner, the user has the option to cool the particle-loaded gas only when he feels it is necessary.

The above object is achieved with a method described in the introduction for cooling a particle-loaded gas in a smoking article in that the particle-loaded gas is guided through a cooling element during the drawing-in action, that the cooling element has a cooling material, that the cooling by the cooling element is implemented by means of an endothermic process of the cooling material, and that the endothermic process is activated by the heated particle-loaded gas.

In the method according to the invention, the cooling material can be chosen such that different endothermic processes can be activated.

On the one hand, it is provided that the endothermic process is implemented by means of desorption. A further possibility is that the endothermic process is implemented by melting the cooling material. Additionally, it is possible that the endothermic process is implemented by releasing water of crystallization of an inorganic salt.

In detail, there are multiple possibilities for designing and further developing the smoking article according to the invention and the method according to the invention as will become apparent from the following description of preferred embodiments with reference to the accompanying drawings.

DETAILED DESCRIPTION OF THE DRAWINGS

Figure 1:
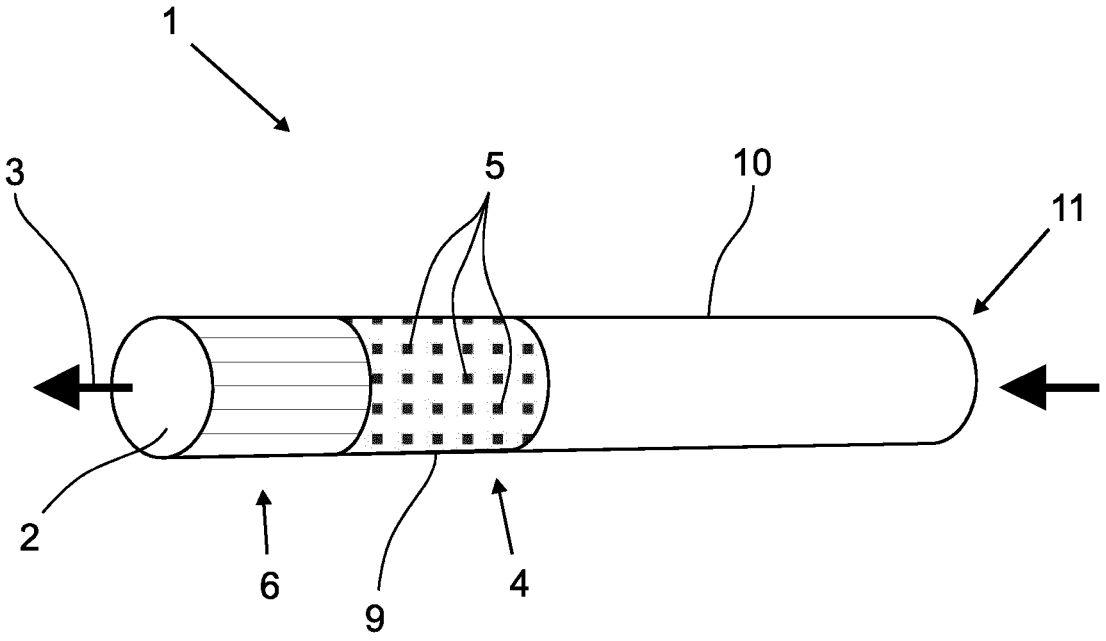
FIG. 1 is a schematic representation of an embodiment of a smoking article with a cooling element.

FIG. 1 shows a smoking article 1 with a mouthpiece 2, through with a particle-loaded gas 3 can flow during the drawing-in action on the mouthpiece 2. The smoking article 1, in the form of a cigarette has a cooling element 4, wherein the cooling element 4 contains a cooling material 5. The cooling element 4 is arranged in front of a filter element 6 in the flow direction of the particle-loaded gas (shown by an arrow). An elongated carrier material 7 is folded and arranged in the cooling element 4 with the folds extending crosswise to the longitudinal direction of the cooling element (see FIGS. 2 and 3), onto which particles 8 of the cooling material 5 are interspersed in the empty spaces between the folded carrier material 7. The cooling element 4 is designed as a separate segment 9 in the cylindrical arrangement of the cigarette. At one end of the cooling element 4, the filter element 6 borders the mouthpiece 2. A covering material 10 borders at the other end, which encases the tobacco section 11.

If the smoking article 1 is lit on the end of the tobacco section 11, the tobacco burns with the covering material 10 at about 800° C. and produces tobacco smoke that can be drawn in via the mouthpiece 2 through the smoking article 1. The smoke is no longer so hot when it reaches the user, but still has a high temperature that can be perceived as unpleasant for the user. The tobacco smoke or, in general, the particle-loaded gas 3 flows through the smoking article 1 and correspondingly through the cooling element 4 in which the cooling material 5 is arranged. The high temperature of the particle-loaded gas 3 is sufficient to activate an endothermic process of the cooling material 5. Energy is required in this endothermic process, which is taken from the particle-loaded gas 3. The extracted energy results in a temperature reduction of the particle-loaded gas 3, which then further flows into the filter element 6 and exits the mouthpiece 2 with a temperature that is perceived as pleasant for the user.

Figure 2:
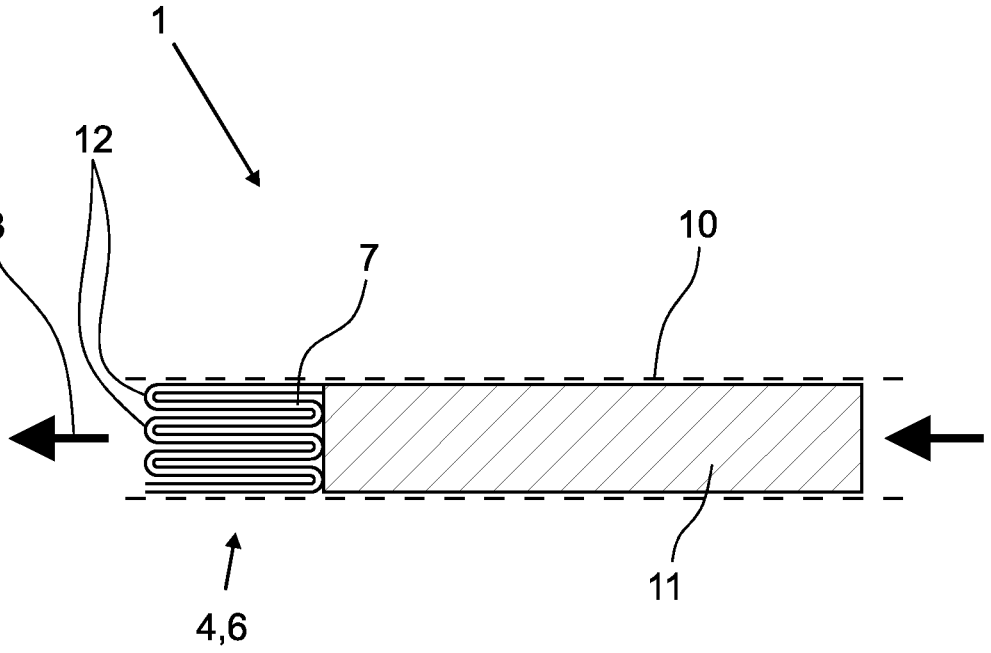
FIG. 2 is a schematic sectional representation of a smoking article with a cooling element.

FIG. 2 shows a section of a sectional representation of a smoking article 1 with a cooling element 5. The cooling element 5 is formed from a multiply-folded carrier material 7. The folds 12 are thereby aligned transverse to the flow direction of the particle-loaded gas 3. The carrier material 7 is accordingly designed to be permeable to air, so that the drawing-in by the user can be easily carried out. The carrier material 7 is coated with the cooling material 5. The cooling material 5 was previously pressed onto the carrier material 7 during production. In this embodiment, the cooling element 4 simultaneously represents the filter element 6, wherein filter material is dispersed between the folds 12 of the carrier material 7 in order to filter out toxins of the particle-loaded gas 3 that are formed by the burning tobacco section 11.

Figure 3:
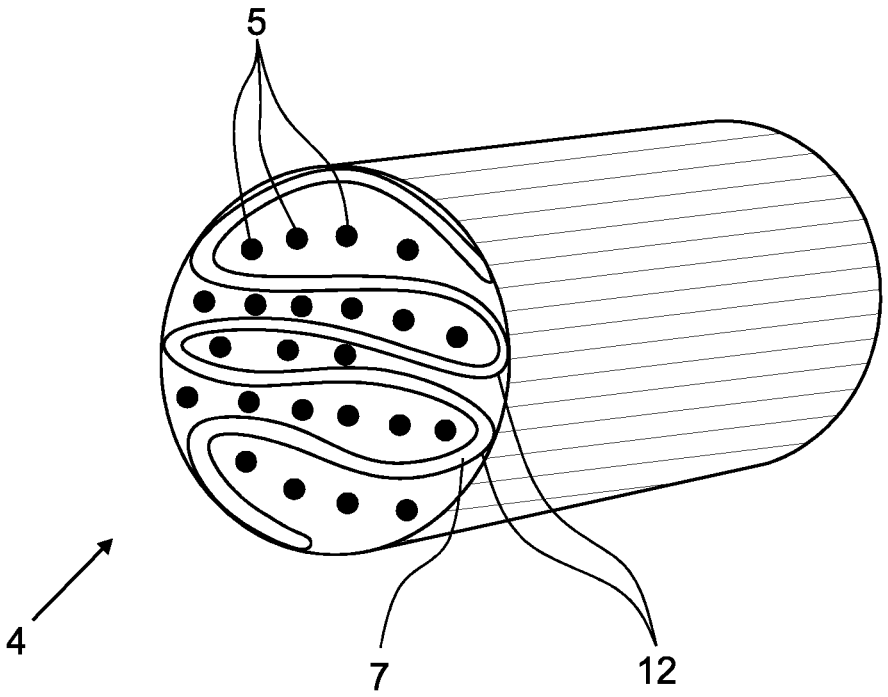
FIG. 3 is a schematic representation of a cooling element for a smoking article and FIG. 4 is a schematic sectional representation of an encapsulated cooling element in a smoking article.

FIG. 3 shows a cooling element 4 for a smoking article 1 in a sectional representation. A carrier material 7 that is folded multiple times is shown. The carrier material 7 is coated with the cooling material 5 by previous pressing of the carrier material 7 with the cooling material 5. Additionally, small particles 8 of the cooling material 5 are arranged between the folds 12 of the carrier material 7 in order to maximize the cooling effect of the cooling element 4. The carrier material 7 of the cooling element 4 is not produced of a material that is permeable to air. The folds 12 of the carrier material 7 thus have to be aligned in the flow direction of the particle-loaded gas 3 in a smoking article 1, so that the particle-loaded gas 3 can flow easily through the cooling element 4 when the user inhales. The surface of the carrier material 7 is thereby only passed by, but not through.

Figure 4:
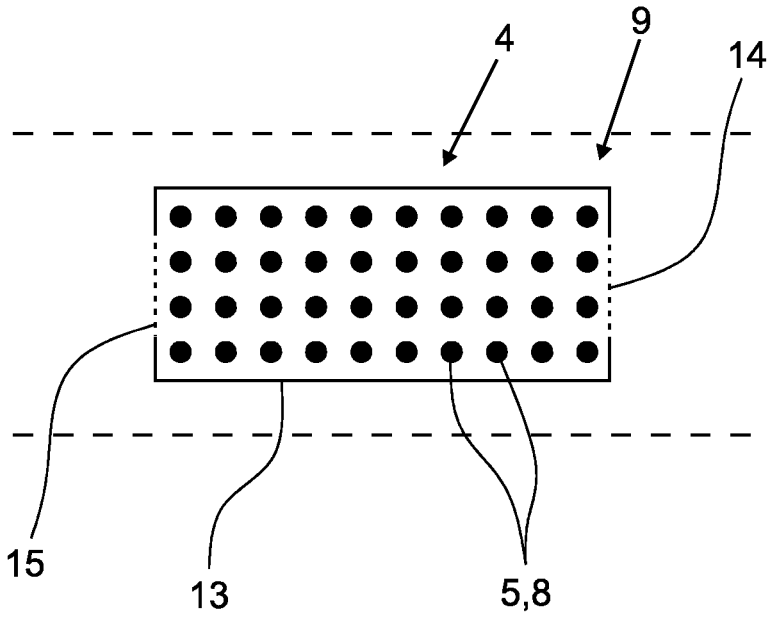

FIG. 4 shows a section of a smoking article 1 in a sectional representation with a separate cooling element 4. The cooling element 4 has a housing 13 on which the cooling material 5 in small porous particles 8 is arranged. The housing 13 is used for enclosing the cooling material 5 so that is it does not scatter into the smoking article 1. The housing 13 of the cooling element 4 has a perforated inlet opening 14 for incoming particle-loaded gas 3 and a perforated outlet opening 15. The particle-loaded gas 3 can flow through the inlet opening 14 and through the outlet opening 15 and thereby comes into contact with the cooling material 5, whereby the cooling of the particle-loaded gas 3 is activated due to the high temperature of the particle-loaded gas 3. The cooling element 4 as separate segment 9 can be removed from the smoking article 1 and can be used when needed. In this manner, a user can decide for himself if he finds it necessary to cool the particle-loaded gas 3 exiting the mouthpiece 2.

The invention claimed is:

1. Smoking article, comprising:

a mouthpiece for drawing in a heated particle-loaded gas, at least one cooling element for cooling the particle-loaded gas, the at least one cooling element being arranged at a location such that the particle-loaded gas will flow through the cooling element during a drawing-in action, wherein the at least one cooling element has a cooling material that is able to produce said cooling by the cooling element by an endothermic process of the cooling material activated by the heated particle-loaded gas, wherein the cooling element comprises an elongate carrier material with the cooling material, and wherein the cooling material has been pressed or brushed onto the surface of the elongate carrier material.

2. Smoking article according to claim 1, wherein the cooling material produces the endothermic process by desorption.

3. Smoking article according to claim 1, wherein the cooling material produces the endothermic process by melting and/or vaporizing of the cooling material.

4. Smoking article according to claim 1, wherein the cooling material produces the endothermic process by releasing water of crystallization of an inorganic salt.

5. Smoking article according to claim 1, further comprising a filter element arranged in front of the mouthpiece in a flow direction of the particle-loaded gas and wherein the cooling element is part of the filter element.

6. Smoking article according to claim 1, wherein the carrier material is folded several times.

7. Smoking article according to claim 6, wherein the cooling material is located in empty spaces between folds of the folded carrier material.

8. Smoking article according to claim 7, wherein the folds are aligned transverse to a direction of the flow through the cooling element.

9. Smoking article according to claim 1, wherein the cooling material is incorporated in the carrier material.

10. Smoking article according to claim 1, wherein the cooling material is incorporated into the cooling element in small particles.

11. Smoking article according to claim 1, wherein the cooling element is arranged in a separate segment in front of the mouthpiece in a direction of flow of the particle-loaded gas.

12. Method for cooling a heated particle-loaded gas in a smoking article having a mouthpiece comprising:

during drawing-in of the heated particle-loaded gas, guiding the particle-loaded gas through a cooling element having an elongate carrier material with a cooling material that has been printed or brushed onto the surface of the elongate carrier material, and performing cooling by the cooling element by an endothermic process of the cooling material, the endothermic process being activated by the heated particle-loaded gas.

13. Method according to claim 12, wherein the endothermic process is implemented by means of desorption.

14. Method according to claim 12, wherein the endothermic process is implemented by melting the cooling material.

15. Method according to claim 12, wherein the endothermic process is implemented by releasing water of crystallization of an inorganic salt of which the cooling material is comprised.

* * * * *